US005820933A

United States Patent [19]

Carroll

[11] Patent Number: 5,820,933

[45] Date of Patent: Oct. 13, 1998

[54] METHOD FOR APPLYING A COATING COMPOSITION CONTAINING A HIGH CONTENT OF ACETONE

[75] Inventor: Kevin R. Carroll, Long Beach, Calif.

[73] Assignee: Western Tube & Condut Corporation, Long Beach, Calif.

[21] Appl. No.: 891,178

[22] Filed: Jul. 10, 1997

[51] Int. Cl.[6] ..... B05D 3/02

[52] U.S. Cl. ..... 427/314; 427/379; 427/388.1; 427/388.5

[58] Field of Search ..... 427/314, 318, 427/385.5, 388.1, 388.5, 379

[56] References Cited

U.S. PATENT DOCUMENTS

| | | | |
|---|---|---|---|
| Re. 34,116 | 10/1992 | Shindou et al. | 428/623 |
| 3,839,069 | 10/1974 | Linturn . | |
| 4,808,440 | 2/1989 | Tasset | 427/372.2 |
| 5,491,031 | 2/1996 | Seibel | 428/458 |

FOREIGN PATENT DOCUMENTS

| | | | |
|---|---|---|---|
| 2816 | 9/1868 | United Kingdom | 427/318 |

*Primary Examiner*—Erma Cameron
*Attorney, Agent, or Firm*—Fulbright & Jaworski

[57] ABSTRACT

A method for applying a coating composition to a substrate is disclosed. A rapid curing process is used to apply the coating composition. The method comprises the steps of forming a coating composition by combining, i) a base paint comprising nonvolatile constituents and a coalescing solvent, and ii) a carrier solvent, b) heating the substrate at a sufficient temperature to promote flashing of the carrier solvent; and c) applying the coating composition to the heated substrate, wherein the carrier solvent is flashed, resulting in a paint film relatively free of carrier solvent, whereby the paint film forms a cured coating on the substrate. The carrier solvent preferably is acetone.

19 Claims, No Drawings

METHOD FOR APPLYING A COATING COMPOSITION CONTAINING A HIGH CONTENT OF ACETONE

BACKGROUND

This invention relates to a method for applying a coating composition on a substrate, particularly paint compositions. Recently, paints have been subjected to more stringent government regulations. Manufacturers of paint can conform to these regulations by producing paints which are less toxic and environmentally safe. One strategy can be to minimize toxic solvents present in paints or coating compositions, for example, benzene-free paint diluents.

However, disadvantages can be associated with some of the paints containing less toxic solvents. These paints can often form immiscible solutions, which can lead to difficulties in obtaining uniform, smooth coatings on substrates where these paints are applied to. Additionally, applications of these paints can difficult.

Conventional applications of paints or coatings are for example, brush coating processes, dipping processes or spray coating processes. Typically, a coating is applied to a substrate, resulting in a coating film that can be dried at room temperature or hardened by heat depending on the type of solvent used.

For the foregoing reasons, there is a need for a method of applying a coating which environmentally safe and exhibits a rapid curing process, is efficient, and can provide durable smooth coatings.

SUMMARY

The present invention is directed to a method of applying a coating to a substrate. The method comprises the steps of forming a coating composition by combining, i) a base paint, and ii) a carrier solvent. The base paint comprises nonvolatile constituents and a coalescing solvent. The substrate is then heated at a sufficient temperature to promote flashing of the carrier solvent. The coating composition is then applied to the heated substrate, wherein the carrier solvent is flashed, resulting in a paint film relatively free of carrier solvent. The resulting paint film forms a cured coating on the substrate.

Generally, the coating composition comprises between about 20% to about 50% by weight of carrier solvent. Preferably, the coating composition comprises about 40% by weight of carrier solvent carrier solvent. All percentages herein are by weight unless stated otherwise.

Typically, the carrier solvent is any low boiling point volatile solvent. The carrier solvent can be selected from the group consisting of ketones, aromatic series solvents, ester series solvents and alcohols. Preferably, the carrier solvent is a ketone. More preferably, the carrier solvent is acetone.

The coalescing solvent can be selected from the group consisting of ketones, aromatic series solvents, ester series solvents and alcohols.

Typically, the coating composition comprises between about 10% to about 30% by weight of nonvolatile constituents. Preferably, the coating composition comprises about 25% by weight of nonvolatile constituents. The nonvolatile constituents can be made up of resins, pigments and fillers.

These and other features, aspects and advantages of the present invention will become better understood with reference to the following description and appended claims.

DESCRIPTION

According to one aspect of the present invention, there is provided a simple, rapid method for applying a coating composition containing a high content of carrier solvent to a substrate. Such a method comprises the steps of forming a coating composition, heating the substrate at a sufficient temperature to promote flashing of the carrier solvent, and applying the coating composition to the heated substrate.

I. FORMING THE COATING COMPOSITION

The coating composition can be formed by combining, a base paint comprising nonvolatile constituents and a coalescing solvent, and a carrier solvent.

A. The Base Paint

The base paint comprises nonvolatile constituents and a coalescing solvent.

Generally, the total content of the nonvolatile constituents employed in this invention can include, but not be limited to, any mixture of pigments, resins and fillers or any other ingredients desirable to provide a coating on a substrate. Typically, pigments such as chromophoric pigments of an inorganic nature, such as, for example, titanium dioxide, iron oxide, carbon black, can be used. Additionally, chromophoric pigments of an organic nature and also customary metallic pigments, such as aluminum bronzes, and alloy steel bronzes also can be used. The level of pigmentation is present within customary ranges known to those skilled in the art. The resins and fillers used in the present invention can be any resins and fillers known to those skilled in the art which are used in paint formulations.

The coalescing solvent, according to the present invention generally can be any solvent or combination of organic solvents to dissolve the nonvolatile constituents. Typical coalescing solvents can be selected from the group consisting of ketones, aromatic series solvents, ester series solvents and alcohols. Preferably, the coalescing solvent is diacetone alcohol, acetyl acetone, cyclohexanone, ethylene glycol monoethylether, ethylene glycol monobutylether, monoethylether acetate, ethyl acetate, butyl acetate or mixtures of these solvents. Solvents of limited water solubility can also be used such as methethyl ketone, pentanone, tetrahydrofuran, ethylene glycol and dimethyl ether for example. More preferably, the coalescing solvent is toluene or xylene.

C. The Carrier Solvent

In this particular invention, the function of the carrier solvent can be to provide a coating composition that is applied to a substrate easily and uniformly, and can be sufficiently removed from the coating composition within a sufficient time for the coating to be cured. To achieve the full advantage of the present invention, the carrier solvent can have a high capture efficiency. Preferably, the carrier solvent has a high capture efficiency and can assist the coalescing solvent present in the coating composition to evaporate rapidly by creating an azeotrope which contains a lower vapor pressure.

Additionally, the carrier solvent is needed to reduce the fluid viscosity of the coating composition, by lowering the nonvolatile constituent's ratio in the coating composition. A sufficient amount of heat can promote the flashing of the carrier solvent, resulting in a paint film relatively free of carrier solvent to form a cured coating. If the carrier solvent chosen was either less volatile or more miscible, the carrier solvent could remain in the coating composition, and may not flash efficiently which can lead to a wet coating.

Preferably, the carrier solvent is nonaqueous, since solvents in water-based coating compositions can be trapped within the resulting paint film, which can result in a wet coating and may not promote a rapid curing process and may take an additional amount to dry.

According to the present invention, the carrier solvent can preferably flash in a few seconds. The flashing of the carrier solvent can result in a rapid curing process which is an efficient and advantageous aspect of this invention. Furthermore, the rapidly flashing carrier solvent can create a lower vapor pressure azeotrope for the coalescing solvent, which would not normally flash off at the temperature that the carrier solvent evaporates at. The carrier solvent can contribute to high capture efficiencies compared to the coalescing solvent. If a high boiling point carrier solvent is used in the present invention, the effect can be a low capture efficiency which can result in the coalescing solvents remaining in the coating composition. Since the resulting paint film would contain more solvents, the curing time could be longer (10–40 minutes, for example) which is not an object of the present invention.

The carrier solvent utilized in the present invention can be any solvent or combinations of solvents that are non-aqueous, volatile, and have a low boiling point sufficient to flash quickly and evaporate during the applying process to form a cured coating. Preferably, the boiling point of the carrier solvent is just above the ambient temperature of the environment at which the coating composition is formed. Typically, the ambient temperature can be between about 60° F. to about 75° F. According to the preferred embodiment of this invention, the boiling point of the carrier solvent used should not be below the ambient temperature of the environment.

Typically, the carrier solvent can be selected from the group consisting of ketones, aromatic series solvents, ester series solvents and alcohols. Preferably, the carrier solvent is a ketone. More preferably, the carrier solvent is acetone.

Additionally, another important feature of the present invention, is that the carrier solvent is preferably free of halogens and is a solvent considered exempt by both the United States Environmental Protection Agency and the South Coast Air Quality District. Acetone can be particulary advantageous as a carrier solvent because of the solvent's low boiling point. Typically, acetone at a high content, exceeding 30% by weight of a composition for example, can be used in paint thinner compositions or nail polish removers. However, according to the present invention, compositions containing a high content of acetone as a carrier solvent is most preferred. Acetone, as a carrier solvent, can result in a rapid flashing when applied to a substrate heated to a sufficient temperature, leaving a paint film relatively free of carrier solvent. The time period that acetone can be flashed off in the present invention, can be about 6 to 10 seconds at 350° F.

As pertained to this particular invention, the high ratio of acetone in the coating composition, can result in an unstable two-phase solution. The nonvolatile constituents can fall out of solution which can result in an immiscible two phase solution. One phase can bear a blend of the carrier solvent with the coalescing solvent. The other phase can be almost entirely carrier solvent. If this paint formulation is unagitated, two distinct layers can appear.

D. The Coating Composition

The coating composition can be made up by conventionally combining in a container, the base paint, and the carrier solvent in any desired order, until all the ingredients form an immiscible two phase solution when standing alone unagitated, or a homogeneous dispersion when mixed. Preferably, when acetone is used, a two-phase immiscible solution is formed.

The amount of carrier solvent can be added to adjust the amount of base paint in the coating composition to a predetermined level to reduce the viscosity. The predetermined level, according to the present invention, can be measured according to the viscosity of the coating composition. Preferably, the coating composition contains a viscosity which is less than 18 seconds in #2 Zahn measurements. This measurement is a method known to those skilled in the art.

Typically, the coating composition between about 10% to about 30% by weight of the nonvolatile constituents. Preferably, the coating composition comprises about 25% by weight of the nonvolatile constituents.

The base paint is included in the coating composition in a sufficient amount to serve its intended purpose, but not in an amount to adversely affect the cured coating on the substrate. Greater dilution of the base paint can result in thinner coatings which can be built up in thickness by repeated applications. An associated increase in the proportion of nonvolatile constituents can result in an increase in viscosity which can lead to a thicker coating requiring additional heat or time for curing.

Generally, the coating composition comprises between about 20% to about 50% by weight of a carrier solvent. Preferably, the coating composition comprises about 40% by weight of a carrier solvent. Greater than 50% by weight of carrier solvent can result in a film that may not be suitable for a cured coating on a substrate.

II. HEATING THE SUBSTRATE

Preferably, the substrate is heated at a sufficient temperature to promote flashing of the carrier solvent. The substrate can be any substrate that a coating can be applied to, i.e., metal, wood, plastic or paper. Preferably, the substrate is metal. More preferably, the substrate is an inner hollow tubular steel tube or pipe. According to the present invention, when the substrate is a metal tube, the tube is long and narrow and is heated to a temperature sufficient to weld the steel tube together. The tube can be quenched to reach the desired temperature. The temperature should not exceed 350° F. but preferably is greater than the carrier solvent's boiling point. If the substrate is greater than 350° F., measures can be taken according to those skilled in the art, to cool the substrate to a desired temperature.

III. APPLYING THE COATING COMPOSITION

Typically, the coating composition is applied to the heated substrate which can cause the carrier solvent to be flashed, resulting in a paint film relatively free of carrier solvent. The paint film can form a cured coating on the substrate. The coating composition, according to the present invention, can be applied to the substrate by any known methods skilled in the art. The substrate which the coating composition is applied to, can be substantially hot, with temperatures not exceeding 350° F.

Preferably, the coating composition is applied to the interior of a continuously welded, narrow hollow steel tube. According to the present invention, the coating composition can be applied with a lance, which can allow the nozzle of the lance to be placed far enough into the hollow tube so that the tube can be quenched from the outside with a water bath. The water bath can allow the temperature of the tube sufficient for the flashing of the carrier solvent.

Preferably, a light application of the coating composition can form an adherence of sufficient quantity of paint film, which can result in a strong, tough adherent coating. The film can be built up to any desired thickness, but is usually between about 0.3 mils to about 3 mils. The thickness should not exceed 3 mils since this thickness can result in a soft coating which can take a longer time to dry. Preferably, the thickness is between about 0.2 mils to 1 mils, more preferably, the desired thickness according to the present invention is about 0.3 mils. A mil is a unit known to those skilled in the art; 1 mil=1/1000 inch. One of the objects of the present invention is to obtain a uniform coating on the substrate.

The following Examples below illustrate one important embodiment of the method of the present invention. The parts and percentages and ratios are on a weight basis unless otherwise specified.

EXAMPLES

The following examples show the improved capture efficiency obtained when using acetone (or other rapidly flashing solvent). Example 2 best represents the spirit of the invention by showing an improved capture efficiency of 97%.

Two other source tests show the improved capture efficiency obtained when using acetone. These experiments were performed almost identically the same method as the following Examples 1 and 2. The capture efficiency improved from 72% to 81%. See CTL Environmental Services, Job numbers: 94-3147 and 96-3202, herein incorporated by reference.

Example 1

CTL Environmental Services (CTL) was contracted by Western Tube & Conduit Corporation to conduct source testing on the exhaust of Mill #4 during inside diameter (ID) coating operations. The objective of the source test was to accurately determine the capture efficiency for volatile organic compounds (VOCs) emitted during tube coating.

In an automated production line, carbon steel tubing is sprayed on the inside diameter (ID) with an ID paint, and then sprayed on the outside diameter (OD) with a separate OD paint. The paint on the tubing is dried using induction coils and then the tubing is cut to size. During these processes (painting, drying and cutting) the area surrounding the tubing is under vacuum. VOC released from the paint is vented to an incinerator via fume hoods and ducting.

PARAMETERS TO BE MEASURED

Physical Measurements

Physical measurements to be made or ascertained at the site included:

Stack cross-sectional area;

Sampling port distance downstream from the last flow disturbance;

Sampling port distance upstream from the atmosphere;

Ambient temperature; and

Barometric pressure

Gas Flow Measurements

Gas flow measurements to be made as part of the test included:

Exhaust temperature;

Velocity traverse;

Static pressure; and

Moisture content

POLLUTANT VALUES TO BE REPORTED

In order to determine VOC capture efficiencies for the Mill #4 ID coating operation, we needed to know the concentration of VOC in the exhaust stream and the rate of VOC release from the spraying. Capture efficiency was to be reported as a percentage of VOC released.

OPERATING CONDITIONS DURING THE TEST

All testing was performed while the automated coating process was operating at steady, normal load conditions. The paint sprayed on the ID of the tubing was Dura Coat Products "Gray Water Base ID Paint" (DC 785). Paint use was quantified by weighing the paint before and after the test.

SUMMARY OF RESULTS

PHYSICAL MEASUREMENTS OF THE SOURCE SITE

Table 1-1 reports the physical dimensions of the stack and sampling ports. The sampling ports were 90 degrees apart. These dimensions were known before the test, and were all re-measured on the test date. The sampling ports were more than 2 diameters downstream from the last flow disturbance and more than 0.5 diameter upstream of the atmosphere; these distances meet the requirements of South Coast Air Quality Management District (SCAQMD).

For gaseous pollutant sampling a stratification check was performed. Since no stratification of the paint fumes was observed, single point sampling was used for all tests.

TABLE 1-1

PHYSICAL MEASUREMENTS AT THE TEST SITE

| Parameter | Value |
|---|---|
| Stack height above ground | 30 ft |
| Stack inside diameter (calculated from circumferential measurement) | 24.43028 inches |
| Sampling port distance downstream from the last flow disturbance | 54 inches |
| Sampling port distance upstream from the atmosphere | 30 ft approx. |
| Sampling port diameter | 3 inches NPT (National Pipe Thread) |
| Sampling port length | 0.25 inch |

GAS FLOW MEASUREMENTS

Measurements to determine gas flow characteristics were made on both runs. Table 1-2 summarizes the results:

TABLE 1-2

RESULTS OF STACK GAS FLOW MEASUREMENTS

| | |
|---|---|
| Velocity | 25.75 feet/second |
| Flow rate (actual) | 5,029 acfm |
| Flow rate (dry, standard) | 4,777b dscfm |
| Static pressure | 0.29 inches $H_2O$ |
| Temperature | 77.6° F. |
| Moisture fraction by volume | 0.0213 |
| Wet molecular weight | 28.605 lb/lb-mole |

TABLE 1-2-continued

| RESULTS OF STACK GAS FLOW MEASUREMENTS | |
|---|---|
| Percent $O_2$ | 20.90[a] |
| Percent $CO_2$ | 0.00[b] |

[a,b]Percent $O_2$ and $CO_2$ values are taken from Mill #2 ID source test report.

POLLUTANT EMISSIONS AND CAPTURE EFFICIENCIES

VOC Released

During testing, 30.540 lb of coating were sprayed in 60 minutes the spraying rate was thus 0.5090 lb/min. CTL's analysis of the coating by ASTM D-1475 and ASTM d-2369-81 found that the density and the total volatile organic content were 1.156 g/ml and 201 g/L, respectively. The coating therefore contained 17.39 percent VOC by weight, and the VOC emission rate was (0.1739)(0.5090 lb/min)=0.088515 lb/min. During the 60-minute sampling run, 5.311 lb VOC were sprayed.

VOC Captured

The amount of VOC captured was determined by multiplying the measured VOC concentration by the exhaust air flow rate. Table 1-3 shows the VOC concentrations and exhaust mass flow rates. Standard conditions for the purpose of calculations were a pressure of 29.92 inches of Hg and a temperature of 520° R.

Capture Efficiency

Capture efficiency is defined here as 100 ($M_{out}/M_S$), where $M_S$ and $M_{out}$ are the mass VOC sprayed and the exhaust mass flow rates, respectively. By this definition, the capture efficiency calculated was 62.53 percent.

NO. 4 MILL INSIDE SURFACE COATING

TABLE 1-3

| VOC EXHAUST CONCENTRATIONS AND MASS FLOWS | |
|---|---|
| Mean VOC Concentration | 275 ppm |
| Exhaust Flow (dry, standard) | 4,777 dscfm |
| Mass Flow Rate | 3.321 pounds/hour |
| Run Time | 60 minutes |

DISCUSSION OF RESULTS

The capture efficiency is calculated as 62.53%.

SAMPLING AND ANALYTICAL PROCEDURES

All tests were performed by the methods specified in Table 1-4. A 60-minute duplicate run was performed for VOC testing. The velocity traverse and the moisture content test (using dry bulb and wet bulb temperature) were performed during the VOC testing. Table 1-5 shows the test schedule.

VOLATILE ORGANIC COMPOUNDS (VOCS)

VOCs at the ID exhaust stack were measured using SCAQMD Method 25.1 (South Coast Air Quality Management District). Method 25.1 (Determination of Total Gaseous Non-Methane Organic Emissions as Carbon) was performed according to the methods known to those with ordinary skill in the art with collection in tanks and traps. Results are reported as total non-methane hydrocarbons as methane.

FLOW RATE AND MOISTURE

The stack flow rate was determined by SCAQMD Methods 1.1 and 2.1 (South Coast Air Quality Management District). Method 1.1 (Velocity and Sample Traverse Determination) and Method 2.1 (Stack Gas Velocity and Volumetric Flow rate) were performed according to those methods known to those with ordinary skill in the art in conjunction with the VOC sampling. Moisture content was determined by dry and wet bulb thermometer measurement and by using a psychrometric chart.

QUALITY ASSURANCE

Proper sample handling procedures were followed throughout the project.

TABLE 1-4

TEST PROCEDURES AT WESTERN TUBE AND CONDUIT CORPORATION

| Parameter | Measurement Technique | Reference Method |
|---|---|---|
| Moisture | Wet Bulb and Dry Bulb Temperatures | |
| Exhaust Gas Flow rate | Pitot Velocity Traverse Methods | SCAQMD 1.1 & 2.1 |
| VOC | TCA/NDIR (Total Combustion Analyzer/Non-Dispersive Infrared Detector) | SCAQMD Method 25.1 |

Test 1-5

WESTERN TUBE AND CONDUIT CORPORATION TEST SCHEDULE

| Date | Time | Test No. | Test Type |
|---|---|---|---|
| August 24, 1995 | 1043/1143 | VOC | VOC, Moisture and Velocity Traverse |

EXAMPLE 2

Energy Environmental solutions (EES) was contracted by Western Tube & Conduit Corporation to perform source testing on the exhaust of Mill #4 during inside diameter (ID) coating operations. All testing was performed while the automated coating process was operating at steady, normal load conditions. The paint sprayed on the ID of the tubing was Dura Coat Products DC 870M. Paint use was quantified by weighing the paint before and after the test.

The objective of the source test was to determine the capture efficiency for volatile organic compounds (VOC) emitted during tube coating.

In an automated production line, carbon steel tubing is sprayed on the inside diameter (ID) with an ID paint, and then sprayed on the outside diameter (OD) with a separate OD paint. The paint on the tubing is dried using coils and then the tubing is cut to size. During these processes (painting, drying and cutting) the area surrounding the tubing is under vacuum. VOC released from the paint is vented to an incinerator via fume hoods and ducting.

Western Tube and Conduit Corporation personnel maintained steady coating operations throughout the test period. There was no shutdown and process equipment failure during the test.

Table 2-1 reports the physical dimensions of the stack and sampling ports. The sampling ports were 90 degrees apart. These dimensions were measured during the test. The sampling ports were more than 2 diameters downstream from the last flow disturbance and more than 0.5 diameter upstream of the atmosphere; these distances meet the requirements of the South Coast Air Quality Management District (SCAQMD) Method 1.1. During traverses, cyclonic flow check was performed.

TABLE 2-1

DIMENSION OF THE STACK AND SAMPLING PORTS

| | |
|---|---|
| Stack inside diameter (calculated from circumferential measurement) | 24.486 inches |
| Sampling port distance downstream from the last flow disturbance | 104 inches |
| Sampling port distance upstream from the atmosphere | 32 inches |
| Sampling port diameter | 3 inches NPT |
| Sampling port length | 0.25 inch |

All tests were performed by the methods specified in Table 2-1. A 60-minute duplicate run was performed for VOC testing. The velocity traverse and the moisture content test (using dry bulb and wet bulb temperature) were performed immediately after the VOC testing. Table 2-2 shows the test schedule.

VOLATILE ORGANIC COMPOUNDS (VOC)

VOC at the ID exhaust stack were measured using SCAQMD Method 25.1 with collection in tanks and traps.

FLOW RATE AND MOISTURE

The stack flow rate was determined by SCAQMD Methods 1.1 and 2.1 in conjunction with the VOC sampling. Moisture content was determined by dry and wet bulb thermometer measurement and by using a psychometric chart.

GAS ANALYSIS

SCAQMD Method 3.1 determined the stack gas analysis by using Fyrite Analyzer.

TABLE 2-2

TEST PROCEDURES AT WESTERN TUBE AND CONDUIT CORPORATION

| Parameter | Measurement Technique | Reference Method |
|---|---|---|
| Moisture | Wet Bulb and Dry Bulb Temperatures | |
| Exhaust Gas Flow rate | Pitot Velocity Traverse | SCAQMD Methods 1.1 & 2.1 |
| VOC | TCA/NDIR | SCAQMD Method Method 25.1 |
| Gas Density | Fyrite Analyzer | SCAQMD Method 3.1 |

Test 2-3

WESTERN TUBE AND CONDUIT CORPORATION TEST SCHEDULE

| Date | Time | Test No. | Test Type |
|---|---|---|---|
| February 6, 1997 | 0935/1035 | VOC | VOC, Moisture and Velocity Traverse |

TEST RESULTS AND DISCUSSION

The VOC capture efficiency for the Mill #4 ID coating operation is calculated on the basis of two following parameters:

the concentration of VOC in the exhaust stream; and the rate of VOC release from the spraying.

The capture efficiency is reported as a percentage of VOC released. The capture efficiency is calculated as 97% for Mill #4 ID. Table 2-3 shows a detailed test summary.

TABLE 2-3

CAPTURE EFFICIENCY TEST SUMMARY
WESTERN TUBE AND CONDUIT CORPORATION
(MILL #4 ID)

| FACILITY | WESTERN TUBE & CONDUIT |
|---|---|
| UNIT | MILL #4 ID |
| COATING MATERIAL | DC 870M |
| EXHAUST AREA (SQ. FT.) | 3.27 |
| SAMPLE TIME (MINUTES) | 60 |
| BAROMETRIC PRESSURE (IN. OF Hg) | 30.47 |
| MEAN DEL P (IN. OF WATER) | 0.4258 |
| MEAN STACK TEMP. (°F.) | 75.1 |
| STATIC PRESSURE (IN. OF WATER) | 0.22 |
| MOISTURE FRACTION | 0.0164 |
| STACK GAS MOLECULAR WEIGHT (WET) | 28.741 |
| STACK GAS VELOCITY (FT/SEC) | 23.9 |
| STACK FLOW RATE (WACFM) | 4,688 |
| STACK GAS FLOW RATE (DSCFM) | 4,566 |
| MEAN VOC CONC. (PPM) | 2296 |
| VOC OUT ($M_{OUT}$) (POUNDS) | 26.50 |
| TOTAL PAINT USED IN 60 MINUTES (POUNDS) | 41.5 |
| PAINT USED PER MINUTES (POUNDS) | 0.692 |
| DENSITY OF THE PAINT (g/m) | 0.883 |
| TOTAL VOLATILE ORGANIC CONTENT IN THE PAINT (g/l) | 581 |
| % VOC BY WEIGHT IN PAINT | 65.80 |
| VOC IN ($M_{IN}$) (POUNDS) | 27.32 |
| CAPTURE EFFICIENCY (($M_{OUT}/M_{IN}$)*100 | 97% |

STACK PARAMETER

CAPTURE EFFICIENCY CALCULATIONS

Stack Gas Velocity $V=K_pC_p[(\Delta p)^{1/2}]_{ave}[T_{stack}MW_{wet})]^{1/2}$ where;

$K_p$=Pitot tube constant=85.49[ft (lb/lb-mole)$^{1/2}$(in. Hg)$^{1/2}$ (°R)$^{-1/2}$ (in. $H_2O$)$^{-1/2}$]

$C_p$=Pitot tube coefficient=0.84 (dimensionless)

$V=(85.49)(0.84)(0.4258)[535.08/(30.48618*28.741)]^{1/2}$ =23.893 ft/sec

Flow Rate, Actual Cubic Feet Per Minute $Q_{wet}$=(Stack Gas Velocity) (Stack Area) (60 sec/min) =(23.893)(3.270)(60) =4,668 wacfm Flow Rate, Dry Standard Cubic Feet Per Minute $Q_{dry}$ =$Q_{wet}$ (1-Moisture Fraction) (520° R/$T_{stack}$) ($P_{stack}$/29.92)

=(4668)(1–0.0164) (520/535.08) (30.4861/29.92)
=4,566 dscfm

CAPTURE EFFICIENCY CALCULATION

VOC OUT ($M_{OUT}$) (POUNDS/HOUR)

$M_{OUT}$=(ppm)*($10^{-6}$)*(MW/SV)*($Q_{sd}$) * (60 min/hr)
Where;
SV=Specific molar volume of an ideal gas: 379.5 cu.ft/lb. mole at 520 F.
$M_{OUT}$=2296*(1/1000000)*(16/379.5)*(4,566)*60
$M_{OUT}$=26.5196 pounds/hour
% VOC by weight in paint
Density of the paint=0.883 g/ml
Total volatile organic content in the paint=581 g/L
(Paint analysis results are attached in the Appendices)
% VOC by weight in paint=65.798

STACK FLOW CALCULATION

Moisture Content
Relative humidity=57% (from psychrometric chart based on dry bulb and wet bulb temperature)
Mean stack temperature=75.1° F.
Saturation vapor pressure, $P_{sat}$, in mb at a stack temperature $T_{stack}$ (°K) is:
$P_{sat}$=(1013.25) exp [13.3185t−1.9760$t^2$−0.6445$t^3$0.1299$t^4$] where;
t=1=(373.17/$T_{stack}$)
At 75.1° F. (297.07° K.), t=−0.256101
$P_{sat}$=29.687 mb
The volume percent of water is:
$H_2O$ (ppmv)=10,000×Relative Humidity×($P_{sat}$/$P_{stack}$) where;
$P_{stack}$=Barometric Pressure+Static Pressure
=30.47 in. Hg+(0.22 in. $H_2O$) (0.07353 in. Hg/in. $H_2O$)
=(30.48618 in. Hg)(1,000 mb/29.53 in. Hg)=1,032.38 mb
$H_2O$ (ppmv)=(10,000) (57) (29.687/1,032.38)=16390.854 ppmv
Volume % $H_2O$=(100) (16390.854×$10^{-6}$)=1.64 percent
Stack Gas Molecular Weight
Dry Molecular Weight
$MW_{dry}$=(0.44) (%$CO_2$)+(0.32) (%$O_2$)+(0.28)(100−%$CO_2$−%$O_2$+%CO)
=(0.44)(1)+(0.32)(19.00)+(0.28)(100−1.00−19.00+0.00)
=0.44+6.08+22.4
=28.92 lb/lb-mole
Wet Molecular Weight
$MW_{wet}$=$MW_{dry}$ (1−Moisture Volume %)+18 (Moisture Volume %)
=(28.92)(1−0.0164)+18(0.0164)
=(28.445712)+18(0.0164)
=28.741 lb/lb-mole VOC IN ($M_{in}$) (POUNDS PER HOUR)

During the coating, Total paint used was 41.50 pounds in 60 minutes. So the spraying rate was 0.692 pounds/minute
Capture Efficiency (($M_{out}$/$M_{in}$)*100)
Capture Efficiency=(26.5196/27.32)*100
=97%

EXAMPLE 3

A third example is the test entitled "VOC Capture Efficiency Test at Western Tube & Conduit Corporation (Mill #4 Inside Diameter Coating," prepared for Western Tube & Conduit Corporation, Long Beach, Calif., prepared by Pratibha Bhagwat, Energy Environmental Solutions, Fullerton, Calif. This test was performed on Feb. 6, 1997 and is incorporated herein by reference.

EXAMPLE 4

A fourth example is the test entitled "VOC Capture Efficiency Test Mill #4 Inside Diameter Coating Western Tube and Conduit Corporation," prepared for Western Tube & Conduit Corporation, Long Beach, Calif., prepared by Ken Kumar, CTL Environmental Services, Signal Hill, Calif. This test was performed on Aug. 24, 1995 and is incorporated herein by reference.

The previously described present invention has many advantages. The advantages include having a simple method for applying a coating composition containing a high content of acetone, to a substrate. The efficiency and rapid curing process makes this method especially valuable in commercial uses. This method can be performed in relatively small area. Additionally, this method provides an application for coatings which can use a variety of solvents, specifically those solvents which are environmentally safe.

Although the present invention has been described in considerable detail with reference to certain preferred versions, other versions are possible. Thus, the spirit and scope of the appended claims should not be limited to the description of the preferred versions contained herein.

What is claimed is:

1. A method of curing a coating on a substrate, by providing a coating composition for a substrate, whereby the curing is accelerated by utilizing the coating composition having acetone in a sufficient quantity to form an immiscible phase.

2. The method of claim 1, further comprising the steps of:
a) forming the coating composition by combining:
i) a base paint comprising nonvolatile constituents and a coalescing solvent; and
ii) acetone as the carrier solvent;
b) heating the substrate at a sufficient temperature to promote flashing of the carrier solvent;
c) applying the coating composition to the heated substrate, wherein the carrier solvent is flashed, resulting in a coating relatively free of carrier solvent; and
d) curing the coating on the substrate.

3. A method for applying a coating on a substrate comprising the steps of:
a) forming a coating composition by combining:
i) a base paint comprising nonvolatile constituents and a coalescing solvent; and
ii) a carrier solvent, wherein the carrier solvent is a low boiling point solvent;
b) heating the substrate at a sufficient temperature to promote flashing of the carrier solvent;
c) applying the coating composition to the heated substrate, wherein the carrier solvent is flashed, resulting in a paint film relatively free of carrier solvent; and
d) curing the paint film on the substrate, whereby the step of curing is accelerated by the carrier solvent in a sufficient quantity to form an immiscible phase.

4. The method of claim 2, wherein the coating composition comprises between about 20% to about 50% by weight of carrier solvent.

5. The method of claim 4, wherein the coating composition comprises about 40% by weight of carrier solvent.

6. The method of claim 2, wherein the coalescing solvent is selected from the group consisting of ketones, aromatic series solvents, ester series solvents and alcohols.

7. The method of claim 2, wherein the coating composition comprises between about 10% to about 30% by weight of nonvolatile constituents.

8. The method of claim 7, wherein the coating composition comprises of about 25% by weight of nonvolatile constituents.

9. The method of claim 2, wherein the nonvolatile constituents comprises resins, pigments and fillers.

10. The method of claim 3, wherein the coating composition comprises between about 20% to about 50% by weight of carrier solvent.

11. The method of claim 10, wherein the coating composition comprises about 40% by weight of carrier solvent.

12. The method of claim 3, wherein the carrier solvent is selected from the group consisting of ketones, aromatic series solvents, ester series solvents and alcohols.

13. The method of claim 12, wherein the carrier solvent is a ketone.

14. The method of claim 13, wherein the carrier solvent is acetone.

15. The method of claim 3, wherein the coalescing solvent is selected from the group consisting of ketones, aromatic series solvents, ester series solvents and alcohols.

16. The method of claim 3 wherein the coating composition comprises between about 10% to about 30% by weight of nonvolatile constituents.

17. The method of claim 16, wherein the coating composition comprises of about 25% by weight of nonvolatile constituents.

18. The method of claim 3, wherein the nonvolatile constituents comprises resins, pigments and fillers.

19. A method for applying a coating on a substrate comprising the steps of:

a) forming a coating composition by combining:
   i) a base paint comprising nonvolatile constituents and a coalescing solvent; and
   ii) 40% by weight of a carrier solvent, wherein the carrier solvent is acetone;

b) heating the substrate at a sufficient temperature to promote flashing of the carrier solvent;

c) applying the coating composition to the heated substrate, wherein the carrier solvent is flashed, resulting in a paint film relatively free of carrier solvent; and d) curing the paint film on the substrate, whereby the step of curing is accelerated by the carrier solvent in a sufficient quantity to form an immiscible phase.

* * * * *